US006651264B2

(12) United States Patent
Halloran et al.

(10) Patent No.: US 6,651,264 B2
(45) Date of Patent: Nov. 25, 2003

(54) FLUSH VALVE ATTACHMENT SYSTEM WITH LOW-PROFILE OUTLET END

(75) Inventors: Daniel N. Halloran, Saukville, WI (US); Andrew H. Matznick, Newton, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/076,004

(22) Filed: Feb. 14, 2002

(65) Prior Publication Data

US 2003/0150052 A1 Aug. 14, 2003

(51) Int. Cl.[7] ..... E03D 1/34
(52) U.S. Cl. ..... 4/378; 4/392; 4/393
(58) Field of Search ..... 4/392, 393, 403, 4/378, 329

(56) References Cited

U.S. PATENT DOCUMENTS

| | | | | |
|---|---|---|---|---|
| 1,963,709 A | | 6/1934 | McManama | |
| 2,016,635 A | | 10/1935 | Henn | |
| 4,433,446 A | * | 2/1984 | Grimstad | 4/378 |
| 5,244,185 A | * | 9/1993 | Clapp et al. | 251/321 |
| 5,353,445 A | | 10/1994 | Denzin | |
| 5,743,327 A | * | 4/1998 | Villa | 165/55 |
| 5,816,627 A | * | 10/1998 | Readman | 285/340 |
| 5,848,442 A | * | 12/1998 | Denzin | 4/395 |
| 6,053,427 A | * | 4/2000 | Wilger et al. | 239/159 |
| 6,401,269 B1 | * | 6/2002 | Andersen et al. | 4/393 |

* cited by examiner

*Primary Examiner*—Gregory L. Huson
*Assistant Examiner*—Amanda Flynn
(74) *Attorney, Agent, or Firm*—Quarles & Brady LLP

(57) ABSTRACT

A flush valve is connectable to a blind hole in a vertical wall of a toilet tank. An overflow member is in fluid communication with a flush valve housing. The flush valve housing is wider than it is higher, and fits into a blind hole in the tank wall of similar cross sectional shape. The tank is formed with an attachment ear. A clip mounted on the housing holds the housing against the tank wall, while the non-circular nature of the housing and blind hole prevent relative rotation there between.

6 Claims, 4 Drawing Sheets

FLUSH VALVE ATTACHMENT SYSTEM WITH LOW-PROFILE OUTLET END

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to flush valves that control the outflow of water from a toilet tank. It is especially useful in connection with "one piece" type low profile toilets.

Many toilets are molded with the tank integral to the bowl. They are thus referred to as one piece toilets. Because of the way the casting is made, the underside of the water tank bottom wall is typically not accessible. Often this is because a channel from the tank to the toilet bowl and/or toilet siphon leg is cast directly underneath the tank. For such toilets, it was difficult to attach a conventional flush valve to the "blind hole" at the bottom of the tank.

In this regard, prior assemblies often clamped the flush valve outlet to the wall by attaching a nut on the opposite side of the wall to the valve outlet end passing through the hole. When there was no easy way to reach the underside of the tank bottom wall, it was difficult to position a nut under the bottom wall and then thread it on to an end of the valve housing.

The art therefore developed flush valve attachment systems-which were suitable for use with blind outlet holes. For example, U.S. Pat. No. 4,433,446 disclosed a bayonet connection between the flush valve and a triangular outlet hole. Also, U.S. Pat. No. 5,353,445 disclosed the use of flexible legs on the flush valve for insertion and attachment through such holes.

A similar problem arose when the outlet hole was in a lower side wall (as distinguished from bottom wall) of the toilet tank. For example, U.S. Pat. No. 2,016,635 required a series of side undercuts forward of the tank to provide access for attachment fasteners. U.S. Pat. No. 5,848,442 applied the concept of a bayonet type connection to a blind side wall outlet hole.

While many of these designs have been helpful in addressing the problem of attachment to blind holes in this context, there is a continuing desire to render one piece toilets more decorative by reducing the height of the tank still further. This is difficult because of the need for a certain volume of water to pass quickly to the bowl during a flush, and due to the need for a minimum volume of water to be stored. Also, the round outlet on the flush valve of U.S. Pat. No. 5,848,442 causes the valve seat to be positioned quite high above the bottom of the tank.

Thus, a need still exists for an improved flush valve mounting assembly, particularly one where the assembly is mountable through a toilet tank sidewall outlet.

SUMMARY OF THE INVENTION

In one aspect the invention provides a flush valve assembly for connection to an essentially vertical wall of a toilet tank via an outlet in the essentially vertical wall. There is an overflow member having a lower portion, and a housing linked to the lower portion and extending there from to an outlet end of the housing which extends essentially horizontally. The outlet end has a passageway that in cross section is wider than it is higher. The housing also has an upper valve seat. A clip is attached to the housing adjacent the housing outlet end.

In preferred forms the passageway is essentially rectangular or elongated oval in cross section. However, it will be appreciated that a variety of other shapes which are wider than high may also be used for the passageway cross section and the accompanying recess in the toilet tank wall. In other preferred forms there is a flange extending radially outward from the housing outlet end, a resilient seal member is positioned around the housing outlet end adjacent the flange, and the clip is mounted to a rearward side of the flange and has flexible arms which extend forward of the gasket.

In another aspect the invention provides a combined flush valve assembly and toilet tank. The toilet tank has an essentially vertical lower front wall with an outlet opening through the lower front wall. There is at least one attachment ear positioned in the tank and adjacent the outlet opening.

An overflow member is provided having a lower portion, and a housing, having an upper valve seat, is linked to the lower portion and extends there from to an outlet end of the housing which extends essentially horizontally into the outlet opening of the tank. The outlet end of the housing has a passageway that in cross section is wider than it is higher and defines a downwardly extending lip. A flexible clip attaches to the housing adjacent the housing outlet end and also contacts the ear to retain the outlet end in the outlet opening in combination with the lip at the outlet end.

The present invention achieves a secure mounting of a flush valve assembly on a vertical wall of a toilet tank even though the outlet hole is a blind hole. Advantageously, the valve seat of the housing can now be at a lower position without sacrificing flow rates.

Further, the device is inexpensive to manufacture, reliable, and easy to install. Also, the device can be used with a variety of different -height tanks if one changes the height of the seat during the molding process, or by other means.

These and still other advantages of the present invention will be apparent from the following description. In that description reference is made to the accompanying drawings, which form a part hereof. The drawings are an illustration of a preferred embodiment of the invention. This embodiment is not intended to define the full scope of the invention. The claims should be looked to for this purpose.

DETAILED DESCRIPTION OF THE PREFERRED EMBODIMENT

Figure 1:
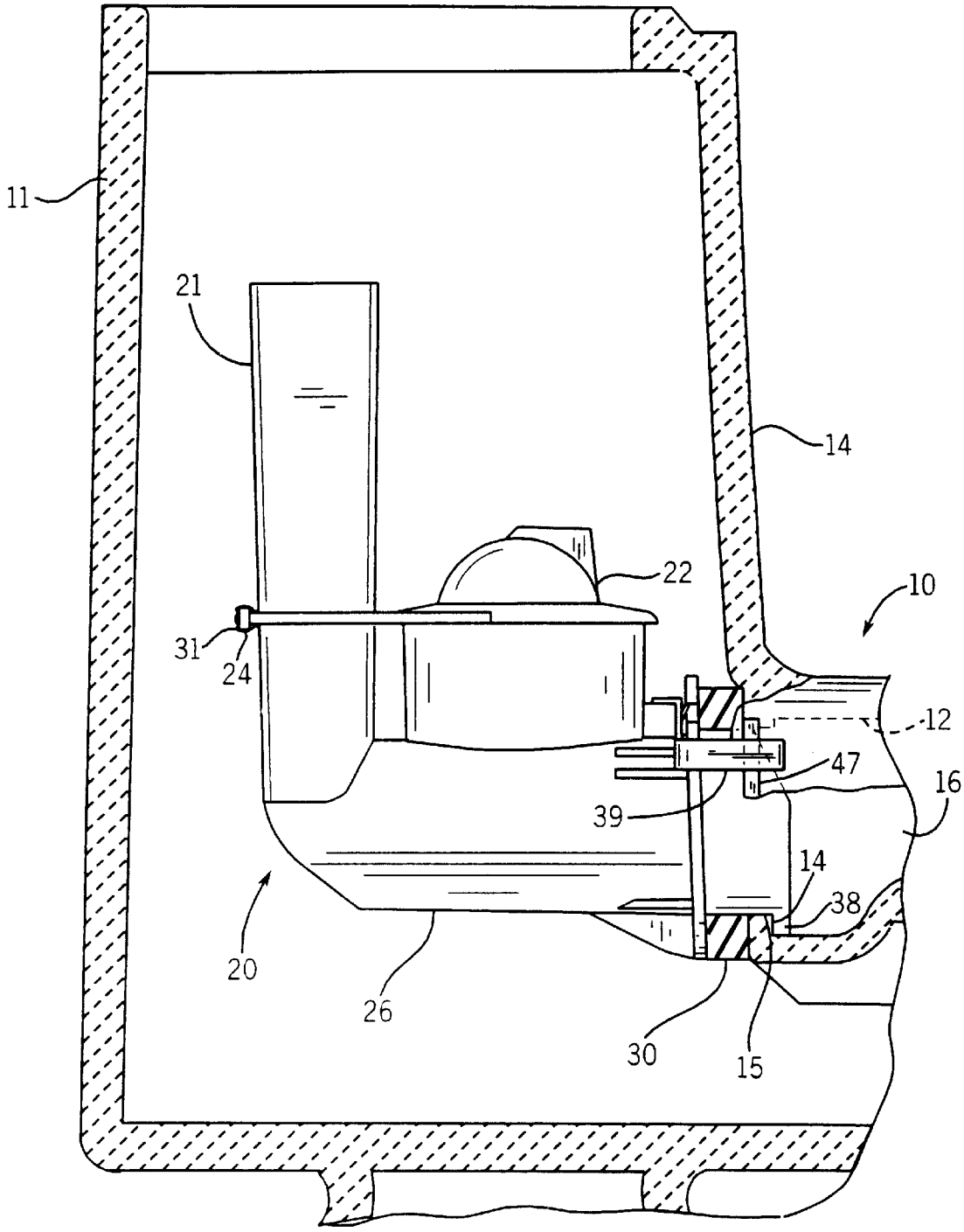
FIG. 1 is a sectional view of a flush valve assembly constructed in accordance with the present invention which has been mounted in the tank of a one piece type toilet.
Figure 2:
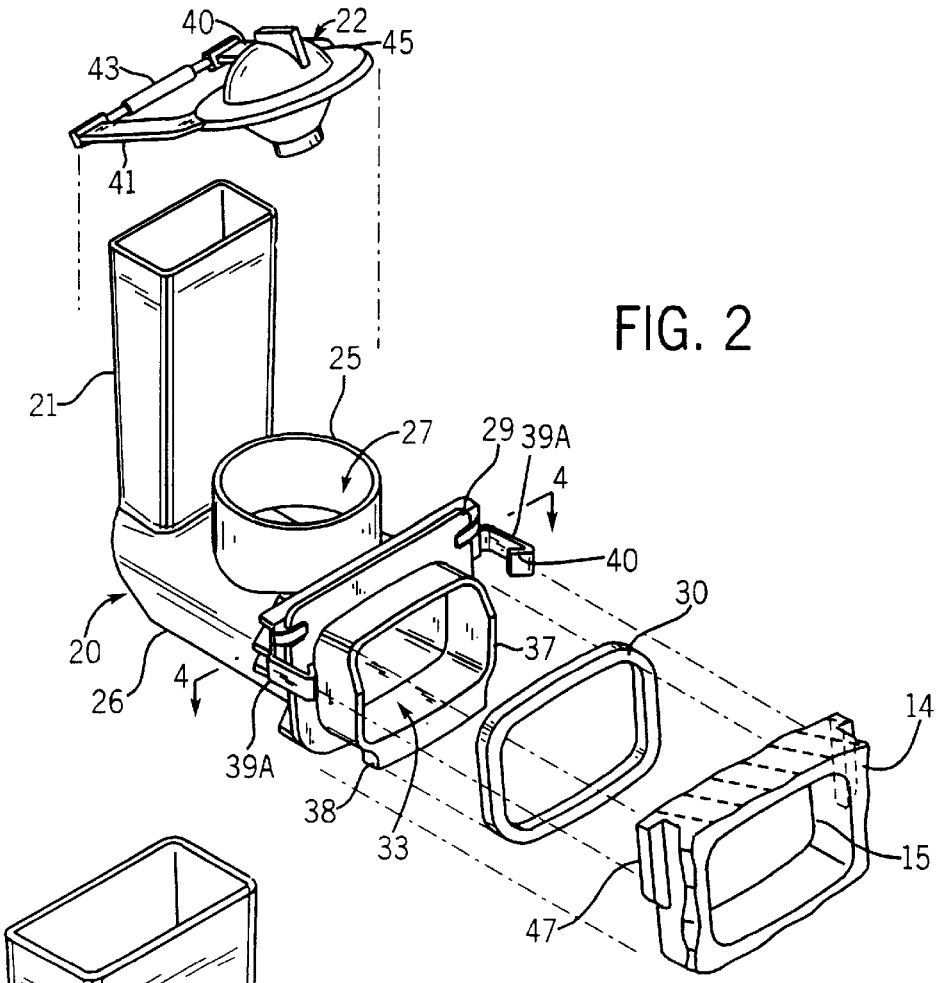
FIG. 2 is an exploded perspective view of the flush valve assembly, with a portion of the tank wall shown.

A one piece toilet, generally 10, includes a tank portion 11 with a frontal essentially vertical wall 14 having an outlet opening 15 leading to a passage 16 in the usual bowl rim 12.

A flush valve assembly 20 in accordance with the present invention is disposed within the lower part of the tank 11. It has the usual vertically extending overflow member 21. A horizontally extending valve housing 26 passes from the base of the overflow section 21 and defines a channel that is operable to deliver water from the tank to the passage 16.

Regardless of the cross section of the overflow 21, housing 26 is of a more "squashed" cross section than a simple circular cross section. For example, the drawings depict a generally rectangular cross section whose horizontal walls 35 define a distance greater than that of its vertical walls 37, while still enabling a volume flow rate equal to or greater than prior art designs having a circular cross section. This permits a lower position for the top edge of the seat 25, and thus a lower profile for the tank 11.

A generally circular seat rim 25 extends upwardly from housing 26, and also defines a cylindrical inlet channel 27. As noted above, the upper edge of the rim 25 provides a valve seat for a flapper valve 22.

Figure 5:
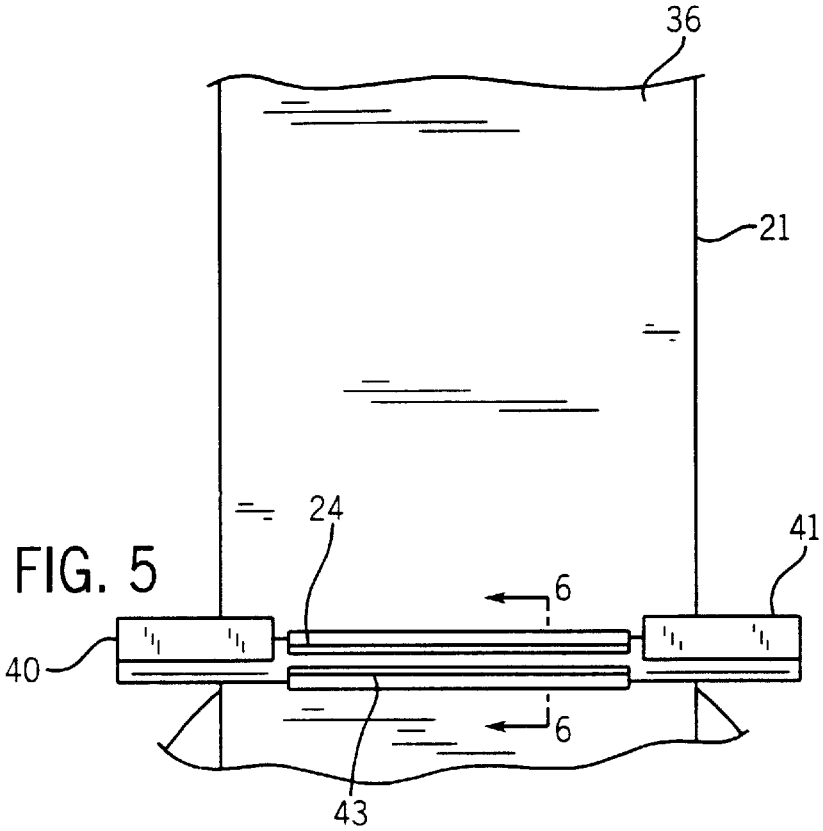
FIG. 5 is a rear view of the overflow tube portion of the flush valve assembly, showing a portion of a flapper valve connected thereto.
Figure 6:
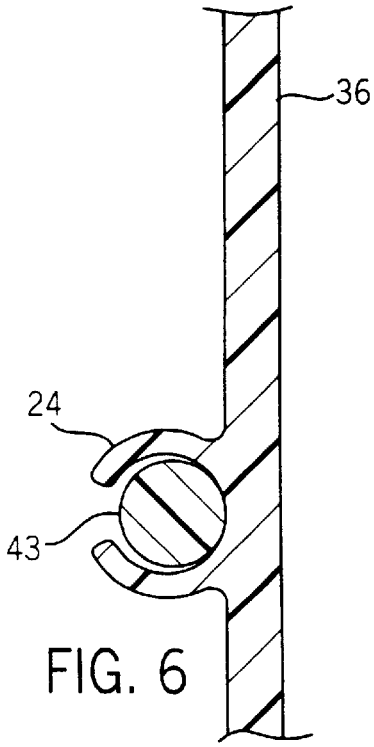
FIG. 6 is a vertical sectional view taken along line 6—6 of FIG. 5.

Referring next to FIGS. 5 and 6, a C-shaped clip 31 extends from the back wall 36 of overflow tube 21, and provides an attachment position for the flapper valve 22. In this regard, the flapper valve 22 has two arm portions 40 and 41 interconnected with a joining portion 43. The flapper valve 22 is composed of the usual elastomeric material.

Figure 3:
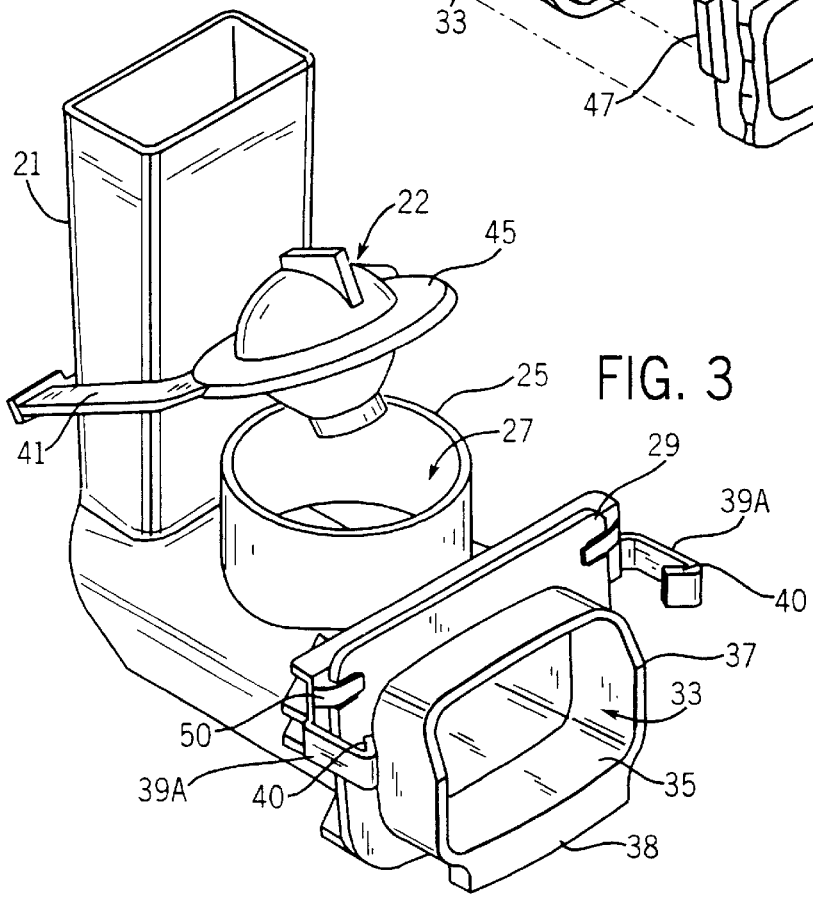
FIG. 3 is a perspective view of the flush valve assembly.

The arm portions 40 and 41 are in turn connected to an essentially flat rim portion 45 which seats on and seals rim 25 (see FIG. 3). FIGS. 5 and 6 show the joining portion 43, of the flapper valve snapped into a selected position. U.S. Pat. No. 5,848,442 generally describes this method of attachment of flapper valves to overflow clips, albeit in the context of multiple such clips.

The flapper valve 22 can be moved off its seat 25 by one of the many known trip lever mechanisms (not shown). In this-regard, when the tank 11 is to be filled, the flapper valve 22 will be in the position shown in FIG. 1, thus preventing the flow of water out of the tank. When the water is to be let out of the tank, the flapper valve will be lifted off rim 25 as shown in FIG. 3 (through the use of a chain attached near the top front of the flapper valve 22).

Particularly now in accordance with the present invention, housing 26 has at its forward end a flange 29 that surrounds its outlet end, yet is offset slightly rearward from open end 33. A lip 38 extends down from the bottom horizontal wall of the housing at the open end. A gasket 30 having a central elongated hole is positioned around end 33 against the flange 29. It has an inner diameter substantially equal to the outer diameter of housing 26, such that the gasket fits snugly thereon. The cross section of opening 15 in the tank wall is shaped substantially identical to the outer edge of end 33 (other than at the lip 38). Thus, with gasket 30 abutting wall 14 around opening 15, a tight fit is created.

Figure 4:
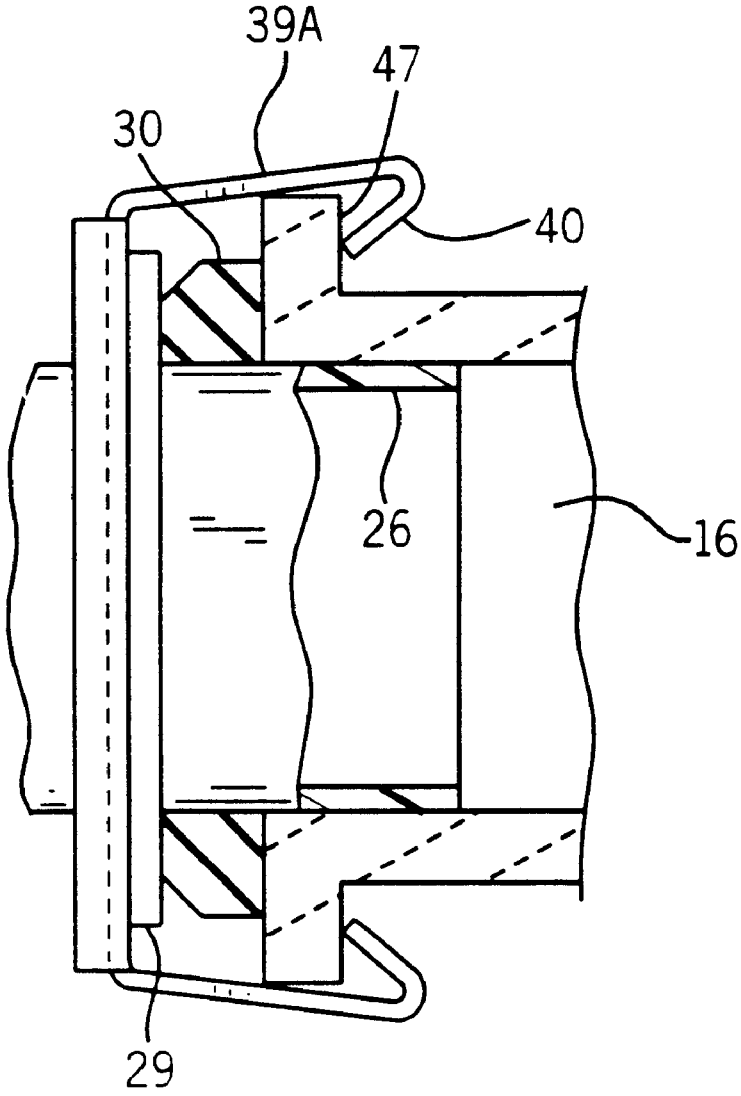
FIG. 4 is a view taken along line 4—4 of FIG. 2.

Referring now also to FIG. 4, a connection member 39 is mounted onto the backside of flange 29, with two arms 39A that extend horizontally forward from the upper end of flange 29. A corresponding pair of ears 47 extend outwardly from the rearward surface of vertical wall 14, and provides catches for the arms 39A. In this regard, the arms have hook shaped hands 40 that flexibly engage the ears.

The connection member 39 can be mounted to the flange by tabs 50 from the connection member that are bent forward through slots on the upper sides of the flange to interlock the parts. Alternatively, an adhesive or other means can be used to attach the connection member to the flange.

During assembly housing 26 is aligned with opening 15 and tilted backward slightly so that the lip 38 can pass over the vertical wall 14. The housing 26 is then titled back upright, which sandwiches the resilient sealing gasket 30 between the flange 29 and wall 14. As the flush valve assembly 20 is inserted, the arms 39A cam over the ears 47. The hands 40 then snap inwardly to lock the connection members in place and secure the tank 11 to the vertical wall 14, thereby creating, with the engagement of the lip 38, a three-point connection. The flush valve assembly 22 is thus quickly attached to vertical wall 14 without requiring access to the other side of the tank wall.

The attachment is particularly secure because the inner end 33 restricts rotation, while the lip 38 and the clip structure prevent rearward movement of the flush valve assembly. Advantageously, the non-circular, flatter shape of the end 33 provides a lower profile to the design, while retaining an outlet cross section of adequate size.

It will be appreciated that in addition to the specific embodiment shown, the invention can appear in other embodiments. For example, it is not critical that this particular type of flapper valve be employed. Thus, there may be various modifications and changes to the embodiment shown that are intended to be within the scope of the present invention. To ascertain the full scope of the invention, the following claims should be referenced.

INDUSTRIAL APPLICABILITY

The invention provides a flush valve assembly for one-piece toilets.

We claim:

1. A flush valve assembly for connection to an essentially vertical wall of a toilet tank via an outlet in said essentially vertical wall, the assembly comprising:

an overflow member having a lower portion;

a housing linked to the lower portion and extending there from to an outlet end of the housing which extends essentially horizontally, the outlet end having a passageway that in cross section is wider than it is higher, the housing also having an upper valve seat; and a clip attached to the housing adjacent the housing outlet end, wherein the clip has forwardly essentially horizontally extending flexible arms with hooked shaped hands at the ends thereof to engage the housing with the outlet.

2. The flush valve assembly of claim 1, wherein the passageway is essentially rectangular or elongated oval in cross section.

3. The flush valve assembly of claim 1, further comprising a flange extending radially outward from the housing outlet end.

4. The flush valve assembly of claim 3, further comprising resilient seal member positioned around the housing outlet end adjacent the flange.

5. The flush valve assembly of claim 4, wherein the clip is mounted to a rearward side of the flange and has flexible arms which extend forward of the seal member.

6. A combined flush valve assembly and toilet tank, comprising:

a toilet tank having an essentially vertical lower front wall with an outlet opening through said lower front wall;

at least one attachment ear positioned in the tank along a rearward surface of said lower front wall and adjacent the outlet opening;

an overflow member having a lower portion;

a housing linked to the lower portion and extending there from to an outlet end of the housing which extends essentially horizontally into the outlet opening of the tank, the outlet end of the housing having a passageway that in cross section is wider than it is higher, the housing also having an upper valve seat; and an essentially horizontally extending flexible clip including a hooked end attached to the housing adjacent the housing outlet end, the hooked end catching the ear to retain the outlet end in the outlet opening.

* * * * *